United States Patent [19]

Tanabe

[11] 4,324,966

[45] Apr. 13, 1982

[54] MENU RESPONSIBLE AUTOMATIC SENSOR SELECTION IN A COOKING UTENSIL

[75] Inventor: Takeshi Tanabe, Higashiosaka, Japan

[73] Assignee: Sharp Kabushiki Kaisha, Osaka, Japan

[21] Appl. No.: 109,501

[22] Filed: Jan. 4, 1980

[30] Foreign Application Priority Data

Jan. 17, 1979 [JP] Japan ..... 54-4642

[51] Int. Cl.[3] ..... H05B 9/06

[52] U.S. Cl. ..... 219/10.55 B; 219/10.55 R; 219/493; 340/602

[58] Field of Search ..... 219/10.55 B, 10.55 R, 219/10.55 F, 10.57, 491, 492, 493, 494, 497, 10.55 A; 126/19 R; 340/602, 588, 584; 99/DIG. 14

[56] References Cited

U.S. PATENT DOCUMENTS

| | | | |
|---|---|---|---|
| 2,942,221 | 6/1960 | Girolamo | 200/5 R |
| 3,012,116 | 12/1961 | Boylan et al. | 200/5 R |
| 3,028,472 | 4/1962 | Baird | 219/10.55 B |
| 3,839,616 | 10/1974 | Risman | 219/10.55 R |
| 4,109,129 | 8/1978 | Satoh et al. | 219/10.55 B |
| 4,133,995 | 1/1979 | Buck | 219/10.55 B |
| 4,162,381 | 7/1979 | Buck | 219/10.55 B |
| 4,181,744 | 1/1980 | Buck | 219/10.55 R |
| 4,188,520 | 2/1980 | Dills | 219/10.55 B |

FOREIGN PATENT DOCUMENTS

| | | | |
|---|---|---|---|
| 2744878 | 4/1978 | Fed. Rep. of Germany | 219/10.55 B |
| 2753405 | 6/1978 | Fed. Rep. of Germany | 219/10.55 B |
| 52-5033 | 1/1977 | Japan | 219/10.55 B |
| 52-5035 | 1/1977 | Japan | 219/10.55 B |
| 52-13150 | 2/1977 | Japan | 219/10.55 B |
| 52-47703 | 3/1977 | Japan | 219/10.55 B |
| 52-61850 | 5/1977 | Japan | 219/10.55 B |
| 54-2541 | 1/1979 | Japan | 219/10.55 B |
| 2002143 | 2/1979 | United Kingdom | 219/10.55 B |

*Primary Examiner*—B. A. Reynolds
*Assistant Examiner*—Mark H. Paschall
*Attorney, Agent, or Firm*—Birch, Stewart, Kolasch and Birch

[57] ABSTRACT

A microwave oven comprises a thermistor and a gas sensor disposed in an exhaustion duct for detecting an exhaustion air temperature and an exhaustion gas concentration, respectively. A menu selection manual lever is disposed on a control panel for selecting a desired cooking menu. A microwave generation control circuit is correlated with the menu selection manual lever in such a manner that the microwave generation is terminated when the thermistor output reaches a preselected value under the condition where a preselected group of cooking menu is selected through the menu selection manual lever, and the microwave generation is terminated when the gas sensor output reaches a predetermined value under the condition where another group of cooking menu is selected through the menu selection manual lever.

10 Claims, 3 Drawing Figures

MENU RESPONSIBLE AUTOMATIC SENSOR SELECTION IN A COOKING UTENSIL

BACKGROUND AND SUMMARY OF THE INVENTION

The present invention relates to a cooking utensil such as a microwave oven, an electric heating oven, a gas oven and a combination thereof.

The present invention relates, more particularly, to a cooking utensil including a plurality of sensors for detecting a cooking condition of foodstuff disposed in the cooking utensil, and an automatic selection feature of the plurality of sensors in response to manual selection of a cooking menu.

A microwave oven has been developed which includes a thermistor for controlling the microwave generation in response to an output signal derived from the thermistor. The thermistor is disposed in an exhaustion duct for detecting an exhaustion air temperature developed from an oven cavity, whereby the microwave generation is terminated when the exhaustion air temperature reaches a preselected value.

Another microwave oven is proposed in my copending application Ser. No. 71,179, "COOKING UTENSIL CONTROLLED BY GAS SENSOR OUTPUT," filed On Aug. 31, 1979, wherein a gas sensor is disposed in an exhaustion duct for detecting a gas concentration developed from an oven cavity. When the gas concentration reaches a preselected value, the gas sensor output shows a preselected value, and in response thereto the microwave generation is terminated.

The thermistor controlled microwave oven is effective when the exhaustion air temperature is higher than 70° C. at the end of the cooking operation. The gas sensor controlled microwave oven is effective for performing the grill operation, for example, for detecting a completion of the broiling of fish. The gas sensor controlled microwave oven is, in addition, suited for warming "sake," wherein the exhaustion air temperature is around 40° C. through 50° C. at a preferred completion of the warming.

Accordingly, an object of the present invention is to provide a cooking utensil responding to output signals derived from a plurality of sensors disposed in the cooking utensil.

Another object of the present invention is to provide an automatic selection circuit for automatically enabling an output signal derived from a preferred sensor in response to manual selection of a cooking menu.

Other objects and further scope of applicability of the present invention will become apparent from the detailed description gives hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a temperature sensing thermistor and a gas sensor are disposed in an exhaustion duct of a microwave oven. A menu selection manual lever is provided on a control panel for selecting a cooking menu among, for example, warming milk, rewarming foodstuff, defrosting and warming SHAO-MAI, warming hamburg steak, warming SAKE, broiling fish, boiling vegetables, and grilling meat. When a desired menu is selected through the menu selection manual lever, the microwave generation operation is conducted till the sensor output shows a preselected value correlated to the respective menu.

A control circuit is provided for automatically selecting the thermistor or the gas sensor in response to the manual selection of the menu. More specifically, when one of the above-mentioned first four menus is manually selected, the control circuit functions to utilize the thermistor output for detecting the completion of the cooking operation. When one of the above-mentioned last four menus is manually selected, the control circuit functions to utilize the gas sensor output for detecting the completion of the cooking operation.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
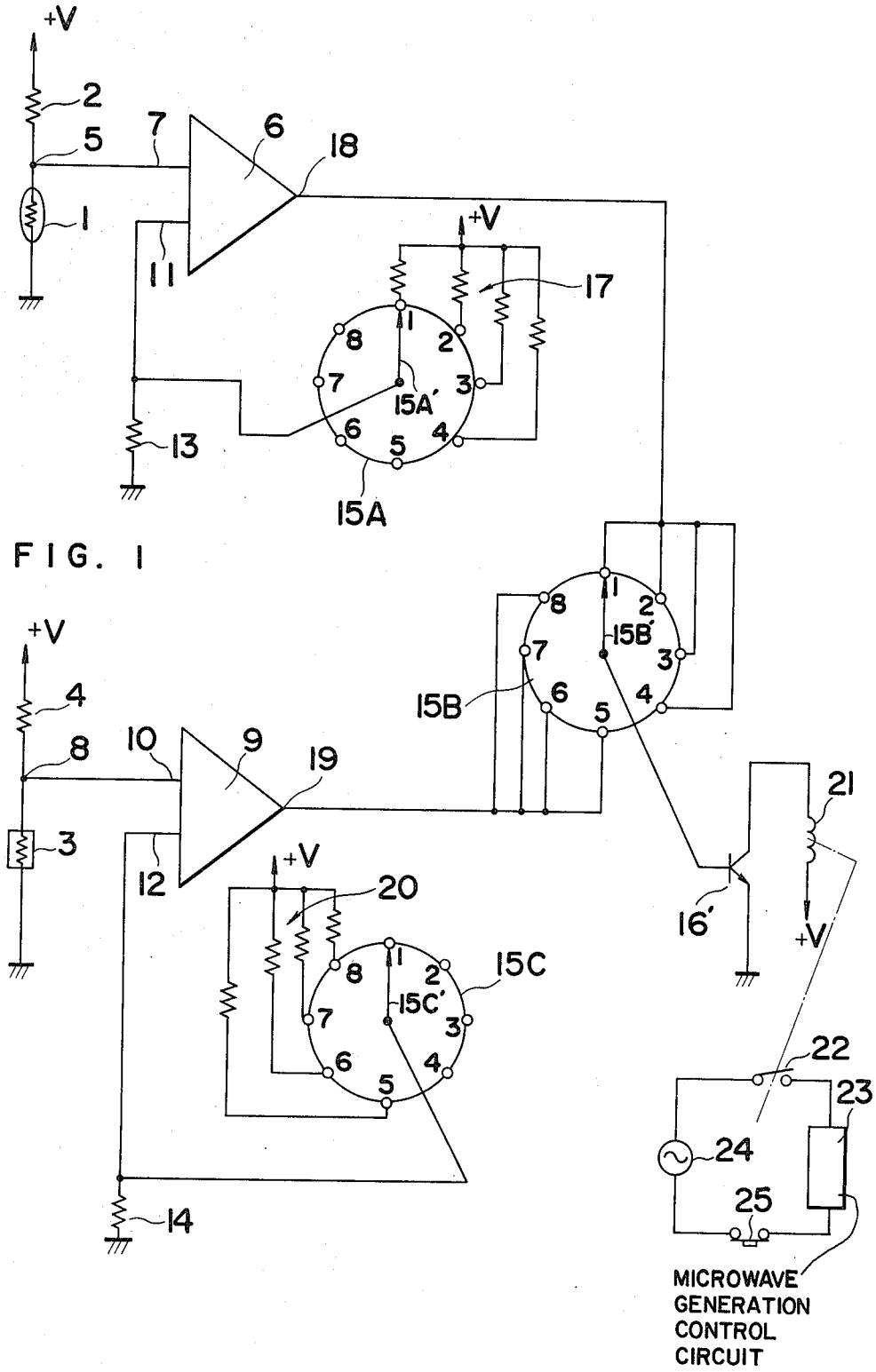
FIG. 1 is a circuit diagram of an embodiment of a sensor selection circuit of the present invention included in a microwave oven.

FIG. 1 shows an embodiment of a sensor selection circuit of the present invention included in a microwave oven.

A thermistor 1 is disposed in an exhaustion duct (not shown) of a microwave oven for detecting an exhaustion air temperature developed from an oven cavity, thereby detecting completion of the cooking operation. A gas sensor 3 is also disposed in the exhaustion duct of the microwave oven for detecting an exhaustion gas concentration developed from the oven cavity, thereby detecting completion of the cooking operation. A preferred gas sensor is "TGS#813" manufactured by Figaro Engineering Inc., and the basic detection operation is described in my copending application Ser. No. 71,179, "COOKING UTENSIL CONTROLLED BY GAS SENSOR OUTPUT," filed on Aug. 31, 1979.

The thermistor 1 is connected to a D.C. power source +V via a resistor 2, and a node 5 is connected to a data input terminal 7 of a first comparator 6. The gas sensor 3 is connected to the D.C. power source +V via a resistor 4, and a node 8 is connected to a data input terminal 10 of a second comparator 9. A reference voltage input terminal 11 of the first comparator 6 is grounded via a resistor 13, and a reference voltage input terminal 12 of the second comparator 9 is grounded via a resistor 14.

A three-piece interlocking rotary switch 15 is provided, which includes a first rotary switch 15A, a second rotary switch 15B and a third rotary switch 15C. The first rotary switch 15A comprises a movable contact 15A' connected to the reference voltage input terminal 11 of the first comparator 6. The second rotary switch 15B comprises a movable contact 15B' connected to a base electrode of a switching transistor 16', and the third rotary switch 15C comprises a movable contact 15C' connected to the reference voltage input terminal 12 of the second comparator 9. Further, the rotary switches 15A, 15B and 15C comprise eight stationary contacts, respectively. The first through fourth stationary contacts of the first rotary switch 15A are connected to the D.C. power source +V via a resistor group 17, which determines desirable circuit constants for the first through fourth stationary contacts, respectively. More specifically, each resistor in the resistor group 17 has a different resistance value from each other. The fifth through eighth stationary contacts of the third rotary switch 15C are connected to the D.C. power source +V via a resistor group 20, which determines desirable circuit constants for the fifth through eighth stationary contacts of the third rotary switch 15C, respectively. More specifically, each resistor in the resistor group 20 has a different resistance value from each other.

The first through fourth stationary contacts of the second rotary switch 15B are connected, in common, to an output terminal 18 of the first comparator 6. The fifth through eighth stationary contacts of the second rotary switch 15B are connected, in common, to an output terminal 19 of the second comparator 9. When the movable contact 15A' of the first rotary switch 15A is connected to one of the first through fourth stationary contacts, one of the resistors included in the resistor group 17 and connected to the selected contact is connected to the resistor 13 in a series fashion, whereby the reference voltage is applied to the reference voltage input terminal 11 of the first comparator 6. Similarly, when the movable contact 15C' of the third rotary switch 15C is connected to one of the fifth through eighth stationary contacts, one of the resistor included in the resistor group 20 is connected to the resistor 14 in a series fashion, thereby applying the reference voltage to the reference voltage input terminal 12 of the second comparator 9.

A D.C. relay 21 is connected between the D.C. power source +V and the collector electrode of the switching transistor 16', and the emitter electrode of the switching transistor 16' is grounded. A relay contact 22 is associated with the D.C. relay 21. A microwave generation control circuit 23 is supplied with power 24 through the relay contact 22 and a cook start switch 25. The microwave generation circuit 23 maybe substituted with a heater control circuit in the case of an electric heating oven.

Figure 2:
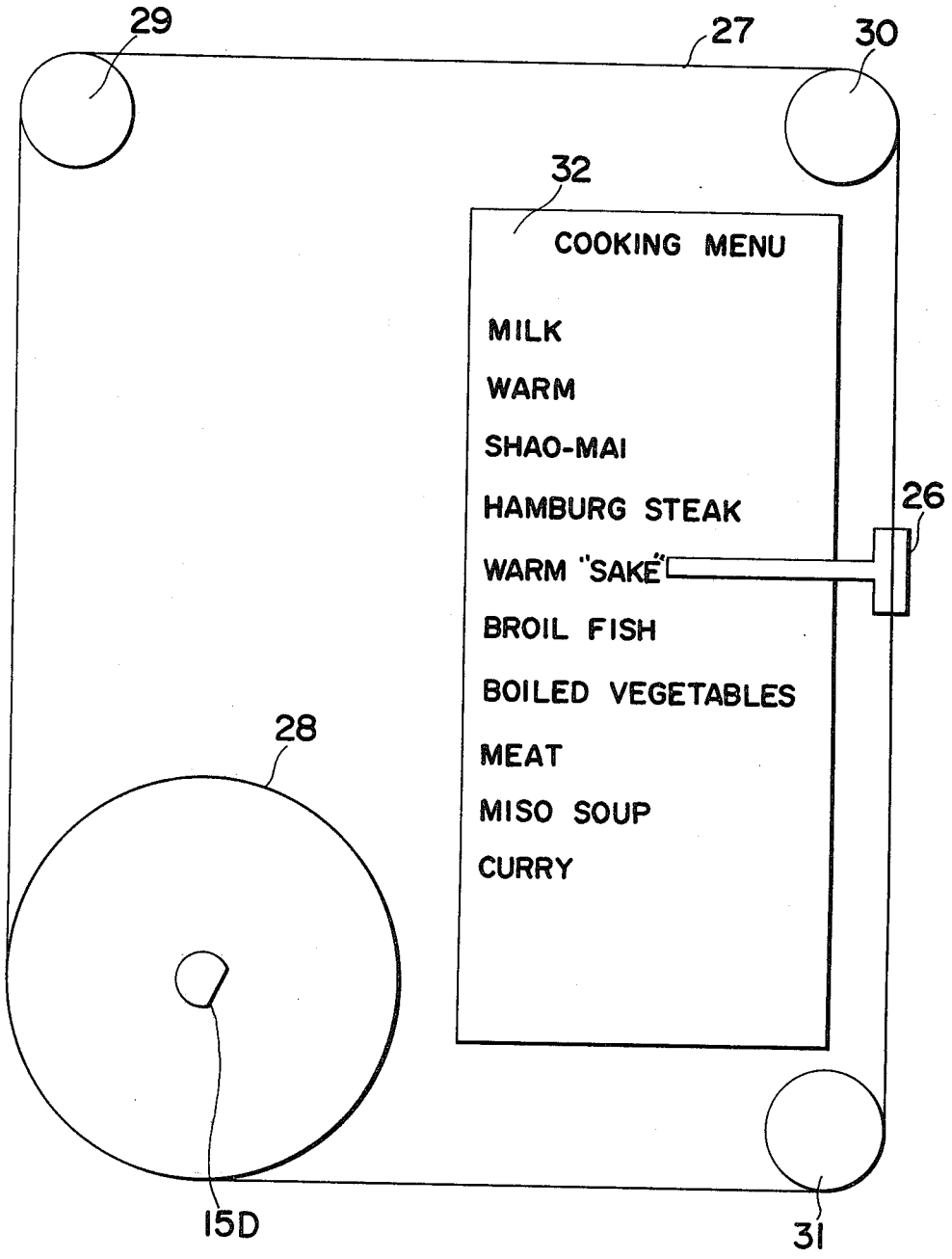
FIG. 2 is a schematic front view of a menu selection mechanism employed by the microwave oven.

FIG. 2 schematically shows a menu selection mechanism associated with the three-piece interlocking rotary switch 15.

The three-piece interlocking rotary switch 15 comprises a shaft 15D secured to a drum 28. A menu selection lever 26 is slidably secured on a menu panel 32 for selecting a desired cooking menu among, for example, warming milk, rewarming foodstuff, defrosting and warming SHAO-MAI, warming hamburg steak, warming SAKE, broiling fish, boiling vegetables, and grilling meat. A belt 27 is fixed to the menu selection lever 26 and extended around the drum 28 and pulleys 29, 30 and 31. Accordingly, when a desired menu is selected through the menu selection lever 26, the three-piece interlocking rotary switch 15 is rotated in response to the manual menu selection.

Figure 3:
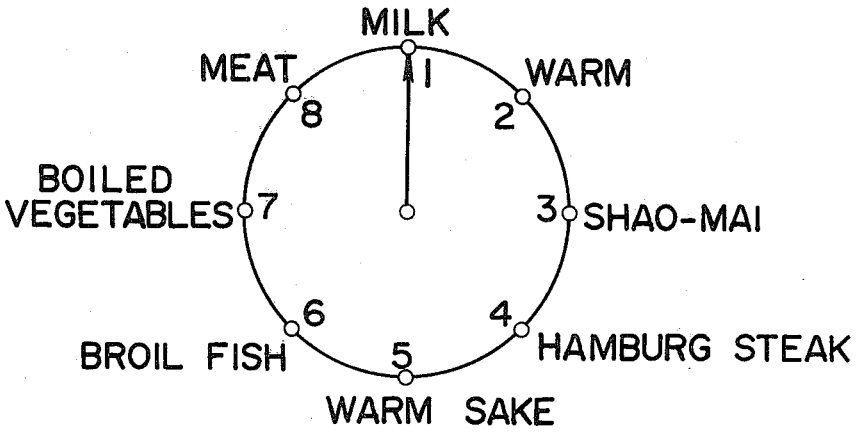
FIG. 3 is a schematic plan view showing the relationship between the menu selection and rotary selection switch terminals.

More specifically, the eight stationary contacts of the three-piece interlocking rotary switch 15 correspond to the respective menu on the menu panel 32 as shown in FIG. 3.

When the cooking menu of warming SAKE is selected by the menu selection lever 26 as shown in FIG. 2, the movable contacts of the respective rotary switches 15A through 15C come into contact, respectively with the fifth stationary contacts. That is, the second comparator 9 associated with the gas sensor 3 becomes operative. When the gas concentration reaches a preselected level, the second comparator 9 develops a detection output to turn on the switching transistor 16'.

In response to the turning on of the switching transistor 16', the relay contact 22 is opened to terminate the cooking operation.

When the cooking menu of warming SHAO-MAI is selected, the movable contacts 15A', 15B' and 15C' are made contact with the third stationary contacts of the rotary switches 15A through 15C, respectively. Under these conditions, the first comparator 6 associated with the thermistor 1 becomes operative. When the exhaustion air temperature reaches a preselected level, the first comparator 6 develops a detection output to turn on the switching transistor 16', thereby terminating the cooking operation.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A cooking utensil comprising:
cooking heat source means;
at least two sensor means for detecting a cooking condition performed by said cooking utensil and developing output signals in response thereto;
menu selection means for selecting a desired cooking menu to be conducted by said cooking utensil, said menu selection means selecting one of said sensor means in accordance with the selected desired cooking menu and establishing a reference level preset; and
control circuit means responsive to said reference level preset and to the output signal from the selected sensor means for controlling the operation of said cooking heat source means in response thereto, said menu selection means further comprising:
correlation means for correlating the selection of one of said sensor means with the selection of said desired cooking menu.

2. The cooking utensil of claim 1, wherein said at least two sensor means are disposed in said cooking utensil for detecting a characteristic of the air exhausted from an oven cavity.

3. The cooking utensil of claim 2, wherein said at least two sensor means comprise a thermistor for detecting an exhaustion air temperature, and a gas sensor for detecting an exhaustion gas concentration.

4. A microwave oven comprising:
microwave generation source means;
at least two sensor means for detecting a cooking condition performed by said microwave oven and developing output signals in response thereto;
menu selection means that select a desired cooking menu to be conducted by said microwave oven, select one of said sensor means to detect the cooking condition, and establish a reference level preset;
a microwave generation control circuit means responsive to the output signal from the selected sensor means and to said reference level preset for terminating the generation of said microwave generation source means when the output signal from the selected sensor means reaches a preselected value established by said reference level preset; and said menu selection means correlating the selection of said desired cooking menu with the selection of said one of said sensor means.

5. The microwave oven of claim 4, wherein said at least two sensor means comprise:

a thermistor for detecting an exhaustion air temperature, said air being developed from an oven cavity; and a gas sensor for detecting an exhaustion gas concentration, said gas being developed from an oven cavity.

6. A cooking utensil in accordance with claim 1, wherein said control circuit means comprises:

comparator means responsive to said reference level preset and to the output signal from the selected sensor means for developing an output signal when the output signal from the selected sensor means exceeds said reference level preset, the operation of said cooking heating source means being controlled in response to the output signal from said comparator means.

7. A cooking utensil of claim 3, wherein said exhaustion gas comprises a reducing gas, said gas sensor detecting the concentration of said reducing gas.

8. The microwave oven of claim 5, wherein said exhaustion gas comprises a reducing gas, said gas sensor detecting the concentration of said reducing gas.

9. A cooking utensil capable of cooking a foodstuff placed therein, comprising:

cooking heat source means;

temperature sensor means for detecting the temperature of an exhaust gas emitted from said foodstuff during the cooking thereof;

gas sensor means for detecting the concentration of said exhaust gas emitted from said foodstuff;

menu selection means for selecting a desired foodstuff to be cooked within said cooking utensil;

sensor selection means responsive to the selection of said desired foodstuff via said menu selection means for selecting and enabling either said temperature sensor means or said gas sensor means depending on said desired foodstuff selected via said menu selection means, said sensor selection means correlating the selection and enablement of one of the sensor means with the selection of said desired foodstuff and developing a reference level output signal; and control circuit means responsive to an output signal from the selected sensor means and to said reference level output signal for terminating the energization of said cooking heat source means when said output signal from the selected sensor means exceeds said reference level output signal.

10. A cooking utensil in accordance with claim 9, wherein said exhaust gas includes reducing gases, said gas sensor means detecting the concentration of said reducing gases.

* * * * *